US007481375B2

(12) United States Patent
Hartney et al.

(10) Patent No.: US 7,481,375 B2
(45) Date of Patent: Jan. 27, 2009

(54) APPARATUSES AND METHODS FOR CONTROLLING THE TEMPERATURE OF A PROCESS FLUID

(75) Inventors: Nicholas A. Hartney, St. Petersburg, FL (US); Winston S. Webb, Largo, FL (US); Gustin W. Cutting, Palm Harbor, FL (US)

(73) Assignee: Honeywell International Inc., Morristown, NJ (US)

( * ) Notice: Subject to any disclaimer, the term of this patent is extended or adjusted under 35 U.S.C. 154(b) by 506 days.

(21) Appl. No.: 11/072,707

(22) Filed: Mar. 4, 2005

(65) Prior Publication Data

US 2006/0237548 A1 Oct. 26, 2006

(51) Int. Cl.
*F24F 11/053* (2006.01)

(52) U.S. Cl. ..... 236/1 C; 62/64; 62/616; 252/67

(58) Field of Classification Search ..... 62/46.1, 62/47.1, 51.1, 64, 104, 114, 480, 601, 602; 252/67

See application file for complete search history.

(56) References Cited

U.S. PATENT DOCUMENTS

| | | | | |
|---|---|---|---|---|
| 2,035,275 | A * | 3/1936 | George et al. | 196/117 |
| 3,473,343 | A * | 10/1969 | Chamberlain | 62/46.1 |
| 3,833,170 | A * | 9/1974 | Marshall | 236/9 R |
| 4,198,828 | A * | 4/1980 | Mercier et al. | 62/50.1 |
| 4,858,678 | A * | 8/1989 | Ladd | 165/104.19 |
| 5,038,571 | A * | 8/1991 | Yokouchi et al. | 62/46.1 |
| 5,333,683 | A | 8/1994 | Arriulou et al. | |
| 5,339,649 | A * | 8/1994 | Kawai et al. | 62/46.1 |
| 5,442,928 | A * | 8/1995 | Laskaris et al. | 62/51.1 |
| 5,457,961 | A * | 10/1995 | Longsworth | 62/51.1 |
| 5,775,811 | A * | 7/1998 | Hiraoka et al. | 374/185 |
| 5,884,485 | A * | 3/1999 | Yamaguchi et al. | 62/3.2 |
| 5,889,456 | A * | 3/1999 | Triebe et al. | 335/300 |
| 5,909,099 | A * | 6/1999 | Watanabe et al. | 320/108 |
| 5,937,656 | A | 8/1999 | Cheng et al. | |
| 6,003,332 | A * | 12/1999 | Foster | 62/601 |
| 6,014,864 | A | 1/2000 | Owen | |
| 6,107,905 | A * | 8/2000 | Itoh et al. | 335/216 |
| 6,116,030 | A * | 9/2000 | Story | 62/7 |
| 6,164,078 | A * | 12/2000 | Lak et al. | 62/47.1 |
| 6,167,955 | B1 * | 1/2001 | Van Brocklin et al. | 165/272 |
| 6,327,427 | B1 * | 12/2001 | Burkett | 392/369 |
| 6,622,496 | B2 | 9/2003 | Cheng et al. | |
| 2003/0122543 | A1 * | 7/2003 | Shirakawa et al. | 324/248 |
| 2003/0200751 | A1 * | 10/2003 | Thomspson et al. | 60/671 |
| 2006/0022779 | A1 * | 2/2006 | Jiang et al. | 335/216 |
| 2006/0225433 | A1 * | 10/2006 | Jammu et al. | 62/6 |

FOREIGN PATENT DOCUMENTS

JP 06273025 A * 9/1994

* cited by examiner

*Primary Examiner*—Cheryl J. Tyler
*Assistant Examiner*—Joseph Corrigan
(74) *Attorney, Agent, or Firm*—Fogg & Powers LLC

(57) ABSTRACT

The present invention provides apparatuses and methods for controlling the temperature of a process fluid. An exemplary apparatus in accordance with the present invention comprises a process fluid tank, a cryogenic fluid tank, and a plurality of heat transfer plates for transferring heat from a process fluid in the process fluid tank to a cryogenic fluid in the cryogenic fluid tank. Heating devices can be used to heat a portion of one or more of the heat transfer plates to regulate the transfer of heat from a process fluid in the process fluid tank to a cryogenic fluid in the cryogenic fluid tank.

34 Claims, 4 Drawing Sheets

APPARATUSES AND METHODS FOR CONTROLLING THE TEMPERATURE OF A PROCESS FLUID

TECHNICAL FIELD

The present invention relates to apparatuses and methods for controlling the temperature of a process fluid. More particularly, the present invention relates to heat exchangers and methods of using such heat exchangers to control the temperature of a process fluid.

BACKGROUND

Cryogenic fluids, such as liquid nitrogen, have been used successfully in a number of low-temperature applications such as for freezing food or other materials. Such cryogenic fluids are also often used for controlling the temperature of a process fluid such as those used in many chilling, cooling, or refrigeration systems. Such temperature control is typically provided by extracting heat from the process fluid to provide a cooling function. This type of temperature control is often used to maintain a process fluid at a constant predetermined temperature.

Using cryogenic fluids for controlling the temperature of many process fluids is challenging. This is because many process fluids have a freezing temperature far above the temperature at which typical cryogenic fluids are used. For example, a common process fluid used in industrial chillers contains water and ethylene glycol. Depending on the ratio of water to ethylene glycol, the freezing temperature of a water/ethylene glycol process fluid will be between about 0 degrees Celsius and minus 50 degrees Celsius. Liquid nitrogen is often used at a temperature of minus 195 degrees Celsius or lower, which is its boiling temperature. Cryogenic fluids can thus provide high heat transfer rates for cooling such process fluids because of the large temperature difference between the cryogenic fluid and a process fluid. However, because of such high heat transfer rates, undesirable freezing of a process fluid is possible when using cryogenic fluids to cool a process fluid. The process fluid can freeze onto internal surfaces of the heat exchanger thereby reducing the flow rate of the process fluid. Moreover, because cryogenic fluids provide such high heat transfer rates, it can be difficult to use cryogenic fluids to control a rate of temperature change in a process fluid or to maintain a steady predetermined temperature for an extended period of time.

One conventional approach used to address the above noted freezing problem is to use a heat exchanger that includes a heat transfer surface attached to a tube. The heat transfer surface is in contact with the tube and can thermally conduct heat away from the tube. For example a bank of cooling fins directly attached to the tube are often used. A process fluid flows through the tube and transfers heat to the heat transfer surface. Liquid nitrogen is poured or sprayed on the heat transfer surface of the heat exchanger to remove heat from the heat transfer surface. One problem encountered with this approach is that ice can build up on the heat transfer surface because moisture in the ambient air will condense and freeze on the liquid nitrogen cooled surface. When ice starts to grow and propagate, the heat transfer surface loses its thermal conductivity. The result is that the heat exchanger loses its heat transfer capacity rapidly or the process fluid in the tube freezes or both. The heat exchanger must then be defrosted before it can be put back to service.

Another known approach for addressing the freezing problem is to mix liquid nitrogen with room temperature nitrogen gas to reduce the driving force of the liquid nitrogen and provide a cryogenic gas with a warmer temperature. However, most of the latent heat of vaporization of the liquid nitrogen is lost in the mixing process and the heat transfer capability of the resulting cryogenic gas is reduced. Although this approach can help to avoid freezing of a process fluid, the rate of liquid nitrogen consumption is significantly increased and may be too high to be economically acceptable.

Yet another approach is to use one or more additional heat transfer fluids with lower freezing points to buffer the effect of the liquid nitrogen. That is, the liquid nitrogen is used to cool a heat transfer fluid (which may be used to cool another heat transfer fluid) and the heat transfer fluid is then used to cool the process fluid. Such an approach can be used to prolong the time it takes for the process fluid to freeze but given enough time, the process fluid may ultimately freeze. Moreover, this approach also adds substantial complexity and cost to a process for controlling the temperature of a process fluid.

SUMMARY

In one aspect of the present invention an apparatus is provided that can use a cryogenic fluid to control the temperature of a process fluid without the above-noted freezing problems. The apparatus includes a cryogenic fluid tank, a process fluid tank, a heat transfer device, and a heater. The cryogenic fluid tank is preferably capable of containing a cryogenic fluid. The cryogenic fluid tank preferably comprises an inlet and an outlet that can be used for flowing a cryogenic fluid through the cryogenic fluid tank. The process fluid tank comprises an inlet and an outlet for flowing a process fluid through the process fluid tank. The process fluid tank is spaced from the cryogenic fluid tank thereby defining an insulating space between the cryogenic fluid tank and the process fluid tank. The heat transfer device is designed so that the heat transfer device is capable of transferring heat between a process fluid in the process fluid tank and a cryogenic fluid in the cryogenic fluid tank. The heat transfer device comprises a first portion positioned in the cryogenic fluid tank so that the first portion can contact a cryogenic fluid in the cryogenic fluid tank, a second portion positioned in the process fluid tank so that the second portion can contact a process fluid in the process fluid tank, and a third portion positioned in the insulating space between the cryogenic fluid tank and the process fluid tank. The heater is designed so that the heater can controllably heat the third portion of the heat transfer device to control the temperature of a process fluid in the process fluid tank.

In another aspect of the present invention, a method is provided for using a cryogenic fluid to control the temperature of a process fluid without the above-noted freezing problem. The method comprises providing a cryogenic fluid tank and a process fluid tank wherein the cryogenic fluid tank and the process fluid tank are spaced from each other to define an insulating space between the cryogenic fluid tank and the process fluid tank. The method also comprises providing a quantity of cryogenic fluid in the cryogenic fluid tank to thermally affect a first portion of a heat transfer device within the cryogenic fluid tank, circulating a process fluid within the process fluid tank to flow over a second portion of the heat transfer device within the process fluid tank, and transferring heat through the heat transfer device from the process fluid to a third portion of the heat transfer device within the insulating space between the cryogenic fluid tank and the process fluid tank, through the heat transfer device, from the process fluid to the cryogenic fluid.

In yet another aspect of the present invention, a method for controlling the temperature of a process fluid by regulating the transfer of heat through a heat transfer device is provided. The method comprises providing a cryogenic fluid tank and a process fluid tank wherein the cryogenic fluid tank and the process fluid tank are spaced from each other to define an insulating space between the cryogenic fluid tank and the process fluid tank. The method also comprises immersing a first portion of a heat transfer device into a cryogenic fluid provided in the cryogenic fluid tank, immersing a second portion of the heat transfer device into a process fluid provided in the process fluid tank, providing a third portion of the heat transfer device in the insulating space between the cryogenic fluid tank and the process fluid tank, transferring heat, through the heat transfer device, from the process fluid to the cryogenic fluid, and regulating the transfer of heat through the heat transfer device from the process fluid to the cryogenic fluid to control the temperature of the process fluid in the process fluid tank.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
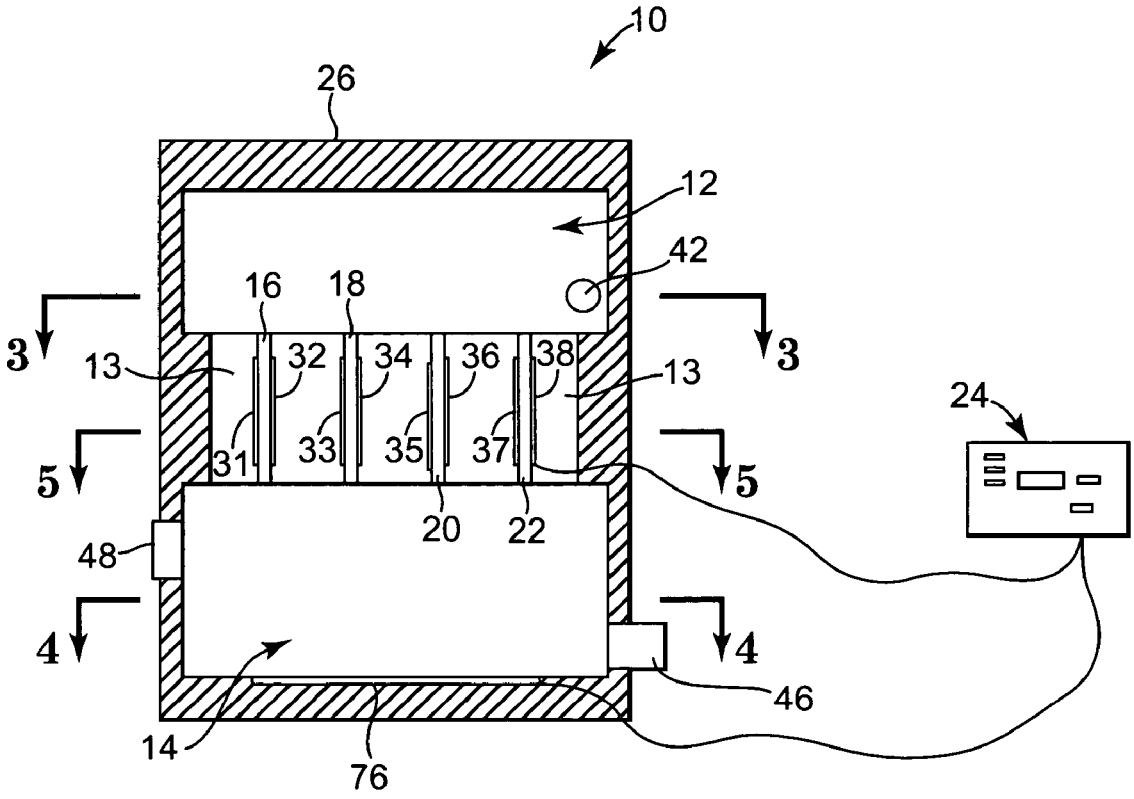
FIG. 1 is a partial cross-sectional side view of an apparatus that can be used to control the temperature of a process fluid showing in particular a process fluid tank spaced from a cryogenic fluid tank and a plurality of heat transfer plates that can be used to transfer heat from a process fluid in the process fluid tank to a cryogenic fluid in the cryogenic fluid tank and a plurality of heating devices that can be used to regulate the flow of heat from the process fluid to the cryogenic fluid in accordance with the present invention.
Figure 2:
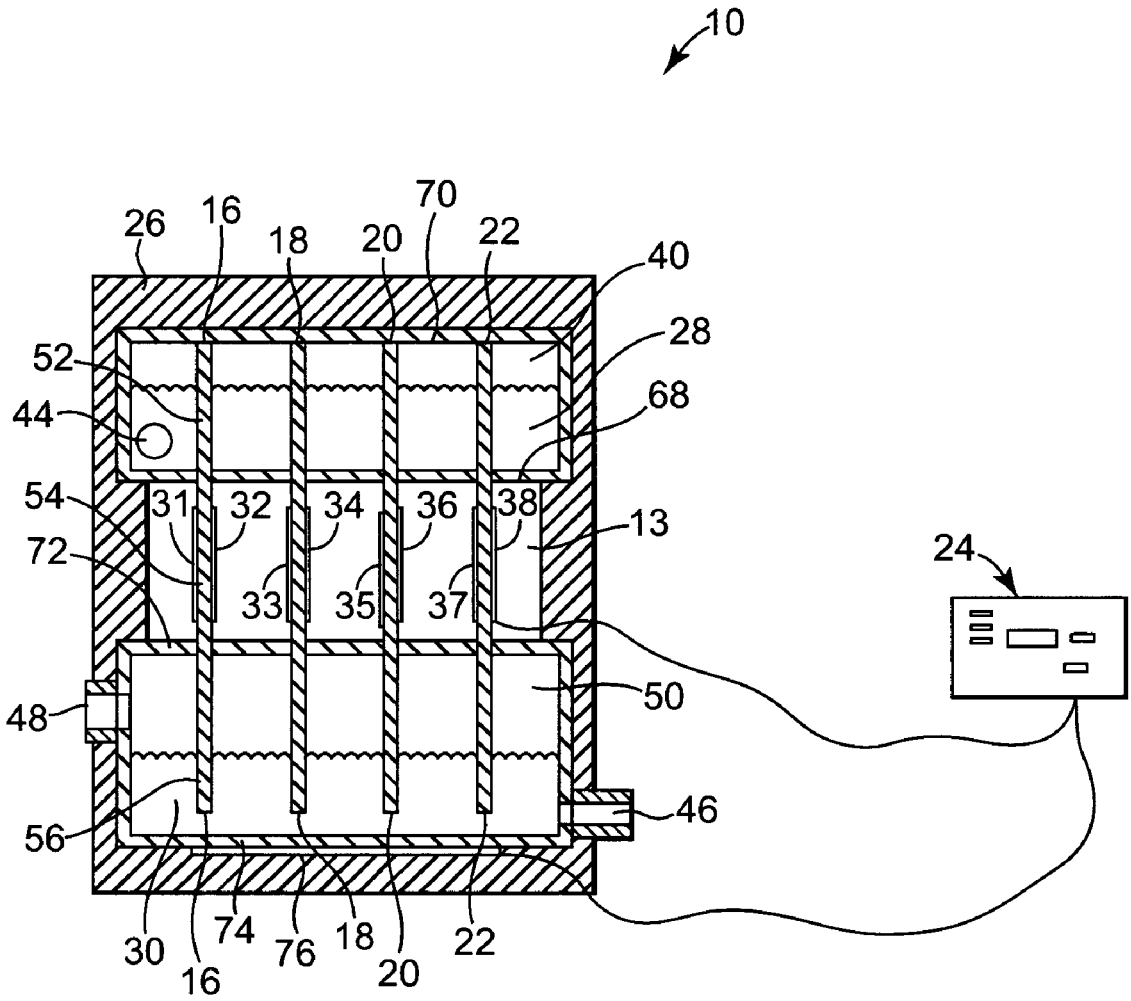
FIG. 2 is a cross-sectional side view of the apparatus of FIG. 1 showing each of the plurality of heat transfer plates as having a portion immersed in a process fluid in the process fluid tank, a portion immersed in a cryogenic fluid in the cryogenic fluid tank, and a portion in an insulating space between the process fluid tank and the cryogenic fluid tank.

In FIGS. 1 and 2 an exemplary apparatus 10 in accordance with the present invention is shown. The apparatus 10 can be used to control the temperature of a process fluid as described in more detail below. As illustrated, the apparatus 10 comprises a process fluid tank 12, a cryogenic fluid tank 14, heat transfer plates 16, 18, 20, and 22, and a control system 24. Preferably, the process fluid tank 12 and the cryogenic fluid tank 14 are spaced from each other, as illustrated, to provide an insulating space 13 between the process fluid tank 12 and the cryogenic fluid tank 14. Also, as shown in cross-section, the apparatus 10 preferably comprises insulating shell 26, preferably in the form of a shell that encloses and insulates the process fluid tank 12, the cryogenic fluid tank 14, and the insulating space 13 as described in more detail below.

In use, a process fluid 28 is provided in the process fluid tank 12 and a cryogenic fluid 30 is provided in the cryogenic fluid tank 14 as can be seen in FIG. 2. As described below, the cryogenic fluid can be flowed through the cryogenic fluid tank 14 or can be provided as a pool that is replenished as needed. Any process fluid that is desired to be temperature controlled can be used. In one exemplary application, the process fluid 28 is delivered to a workpiece holder (not shown) after being temperature controlled by the apparatus 10. The workpiece holder (not shown) may be provided in a vacuum chamber, for example. The process fluid 28 flows through the workpiece holder (not shown) and is used to control the temperature of the workpiece holder (not shown). An electronic device (not shown) can be positioned on the workpiece holder (not shown) and tested as subjected to a predetermined temperature, for example. Other applications of the apparatus 10 are contemplated including cooling semiconductor processing equipment and the like. Herein the term "cryogenic fluid" generally refers to a liquid or gas (or combination of liquids and/or gases) that has a temperature below (i.e., colder than) about minus 100 degrees Fahrenheit at an atmospheric pressure of one atmosphere. Such cryogenic fluids and handling techniques are well known and may include nitrogen, helium, hydrogen, argon, neon and air.

Typically, process fluid 28 is at a higher temperature than the cryogenic fluid 14 and the cryogenic fluid 14 is used to cool the process fluid 28 in accordance with the present invention. Such cooling can be provided by transferring heat from the process fluid 28 to the cryogenic fluid 30. As shown in FIG. 2, portions of the heat transfer plates, 16, 18, 20, and 22, are immersed in the process fluid 28 and other portions in the cryogenic fluid 30. Because of the temperature difference between the process fluid 28 and the cryogenic fluid 30, heat can be transferred from the process fluid 28 to the cryogenic fluid 30 in order to cool the process fluid 28. Such heat transfer can be advantageously regulated by controllably adding heat to a portion of the heat transfer plates, 16, 18, 20, and 22 in accordance with the present invention. Advantageously, the heat transfer plates, 16, 18, 20, and 22 can also be used to remove frozen process fluid from a heat transfer plate or from an inside surface of the process fluid tank 12 as describe below. For example, in the exemplary apparatus 10, heating devices 31, 32, 33, 34, 35, 36, 37, and 38, as controlled by the control system 24, can be used to variably heat the heat transfer plates, 16, 18, 20, and 22, respectively, as described in greater detail below.

The process fluid tank 12 comprises a fluid inlet 42 (FIG. 1) and a fluid outlet 44 (FIG. 2) that are provided for circulating the process fluid 28 through an interior space 40 of the process fluid tank 12. Any desired means can be used to circulate or flow the process fluid 28 through the process fluid tank 12 such as by using a pump or the like (not shown). In use, the process fluid 28 enters the process fluid tank 12 via the fluid inlet 42 at a first temperature. The heat transfer plates 16, 18, 20, and 22 can then be used to remove heat from the process fluid 28 as described below. The process fluid 28 can then exit the process fluid tank 12 via the fluid outlet 44 at a second predetermined temperature that is lower than the first temperature.

As shown, the cryogenic fluid tank 14 comprises a fluid inlet 46 and a fluid/gas outlet 48 that are used for providing the cryogenic fluid 30 in an interior space 50 of the cryogenic fluid tank 12 so that the cryogenic fluid 30 can functionally contact the heat transfer plates 16, 18, 20, and 22 to cause heat transfer between the process fluid 28 and the cryogenic fluid 30. It is generally preferred to avoid flowing the cryogenic fluid 30 through the interior space 50 of the cryogenic fluid tank 14 although it can be if desired. This is because cryogenic fluids can be costly and it is generally desired to use such fluids efficiently. Thus, rather than circulating the cryogenic fluid 30 through the interior space 50 of the cryogenic fluid tank, the cryogenic fluid 30 is preferably maintained at a generally constant level or pooled within the interior space 50 of the cryogenic fluid tank 14 and replenished as needed.

As shown, the level of the cryogenic fluid 30 is preferably maintained below the fluid/gas outlet 48 and the fluid inlet 46 is preferably provided below the fluid/gas outlet 48. When present in the cryogenic fluid tank 14 during use, the cryogenic fluid 30 can boil off into the interior space 50 of the cryogenic fluid tank 14 and then exit through the fluid/gas outlet 48 in a gaseous form. As the cryogenic fluid 30 boils off and the level of the cryogenic fluid 30 in the interior space 50 of the cryogenic fluid tank 14 decreases, the cryogenic fluid 30 is preferably replenished to maintain the level of the cryogenic fluid 30. This can be done, for example, by flowing cryogenic fluid into the interior space 50 of the cryogenic fluid tank 14 at a constant rate equal to the rate of boil off or by replenishing a boiled off portion of the cryogenic fluid 30 at predetermined intervals. Another approach that can be used is to provide a liquid level sensor or the like that can sense the level of the cryogenic fluid 30 in the interior space 50 of the cryogenic fluid tank 14 and open a valve to a supply of cryogenic fluid connected to the fluid inlet 46 when the level of the cryogenic fluid 30 reaches a predetermined level. By adding cryogenic fluid 30 to the cryogenic fluid tank 14 in this way, less cryogenic fluid 30 can be used as compared to constantly circulating cryogenic fluid 30 through the cryogenic fluid tank 14.

As noted above, the process fluid tank 12 and the cryogenic fluid tank 14 are preferably spaced from each other to define the insulating space 13. The insulating shell 26 also preferably surrounds the process fluid tank 12 and the spaced cryogenic fluid tank 14 and preferably defines the insulating space 13 along with the process fluid tank 12 and cryogenic fluid tank 14. Thus, the insulating space 13 preferably comprises an air space as illustrated. However, the insulating space 13 may comprise an insulating material such as is conventionally known.

As illustrated, a portion of each of the heat transfer plates 16, 18, 20, and 22 is provided in the insulating space 13. In accordance with the present invention, each of the heat transfer plates 16, 18, 20, and 22 comprises a portion that is positioned in the process fluid chamber 12, a portion that is provided in the insulating space 13, and a portion that is provided in the cryogenic fluid tank 14. For example, heat transfer plate 18 includes a portion 52 that is positioned in the process fluid chamber 12, a portion 54 that is provided in the insulating space 13, and a portion 56 that is provided in the cryogenic fluid tank 14. The remaining heat transfer plates 18, 20, and 22 are provided in a similar manner as heat transfer plate 16 as illustrated. In any case, any number of heat transfer plates, including a single plate, can be used.

Figure 3:
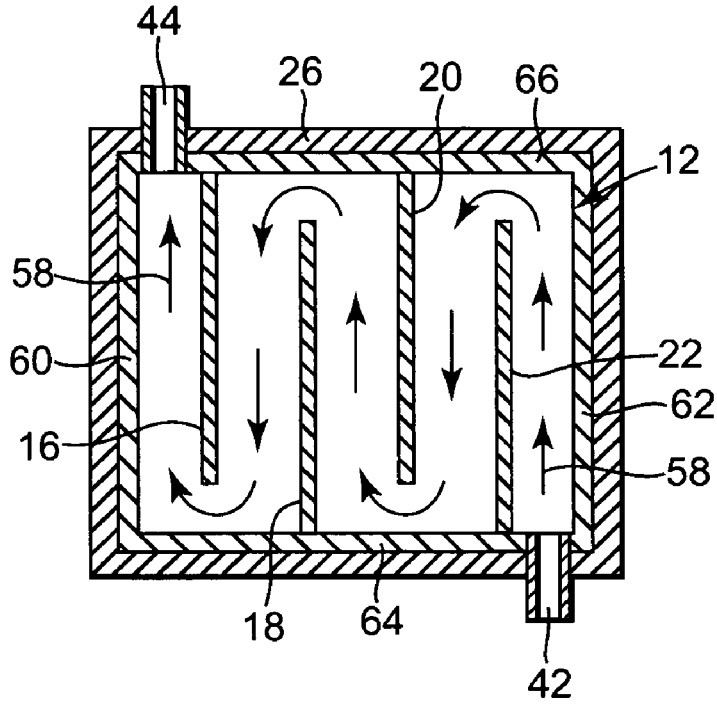
FIG. 3 is a section view of the process fluid tank of the apparatus of FIG. 1 taken along the line 3-3.

Referring to FIG. 3, a cross-sectional view of the process fluid tank 12 of the apparatus 10 of FIG. 1 as taken along the line 3-3 is shown. Preferably, the heat transfer plates 16, 18, 20, and 22 are arranged to provide a predetermined fluid path 58 between the inlet 42 and outlet 44 although no specific fluid path is required. This can be done, as shown in the exemplary process fluid tank 12, by evenly spacing the heat transfer plates 16, 18, 20, and 22 across the distance between a wall portion 60 and a wall portion 62 of the process fluid tank 12 as shown. The heat transfer plates 16 and 20 are designed so that there is a gap between a wall portion 64 of the process fluid tank 12 and an end of the heat transfer plates 16 and 20 as illustrated. Likewise, the heat transfer plates 18 and 22 are designed so that there is a gap between a wall portion 66 of the process fluid tank 12 and an end of the heat transfer plates 18 and 22. This way, a serpentine fluid path 58 is defined and the process fluid 28 can flow from the inlet 42 to the outlet 44 as guided by the heat transfer plates 16, 18, 20, and 22. This causes the process fluid 28 to come in contact with each of the heat transfer plates 16, 18, 20, and 22 so that each of the heat transfer plates 16, 18, 20, and 22 can contribute to transferring heat from the process fluid 28 to the cryogenic fluid 30 in accordance with the present invention. Also, as shown in FIG. 2, each of the heat transfer plates 16, 18, 20, and 22 preferably extend between a bottom wall portion 68 and a top wall portion 70 of the process fluid tank 12 but are not required to do so.

Figure 4:
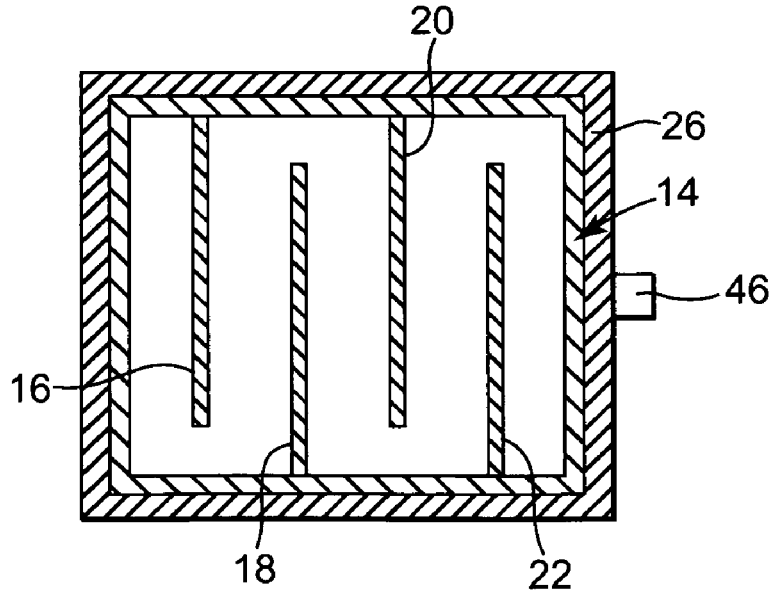
FIG. 4 is a section view of the cryogenic fluid tank of the apparatus of FIG. 1 taken along the line 4-4.

With reference to FIG. 4, a cross-sectional view of the cryogenic fluid tank 14 of the apparatus 10 of FIG. 1 as taken along the line 4-4 is shown. As shown, the heat transfer plates 16, 18, 20, and 22 are arranged in a similar manner as in the process fluid tank 12 because the heat transfer plates 16, 18, 20, and 22 are preferably continuous plates that extend from the process fluid tank 12, through the insulating space 13, and into the cryogenic fluid tank 14. However, the heat transfer plates 16, 18, 20, and 22 do not need to be continuous plates as described below and only need to be able to transfer heat from the process fluid 28 to the cryogenic fluid 30. Moreover, a predetermined fluid flow path for the cryogenic fluid 30 is generally not needed because the cryogenic fluid 30 is typically not circulated through the cryogenic fluid tank 14 as discussed above. As such, the heat transfer plates 16, 18, 20, and 22 pass through a top wall portion 72 of the cryogenic fluid tank 14 but do not need to extend all the way to a bottom wall portion 74 of the cryogenic fluid tank 14 although they may if desired.

While the exemplary apparatus 10 uses the heat transfer plates 16, 18, 20, and 22 to provide heat transfer between the process fluid 28 and the cryogenic fluid 30, it is noted that the present invention is not limited to the use of plates or plate-like structures for providing such heat transfer. Any thermal transfer medium, body, or structural element having any shape, structure, or form that is capable of transferring heat from the process fluid 28 to the cryogenic fluid 30 may be used. For example, beams, rods, tubes, fins or any other structures that preferably include at least some surface area that can be immersed in the process fluid 28 and the cryogenic fluid 30 can be used in accordance with the present invention. Such thermal transfer bodies may include openings that form meshes, grids, honeycomb structures, or the like. Any number of heat transfer bodies may be used, including monolithic structures, depending on such factors as the rate at which the temperature of the process fluid 28 is to be changed, the magnitude of temperature change for the process fluid 28, the desired throughput for the process fluid 28, the temperature of the cryogenic fluid 30, and the like.

Figure 5:
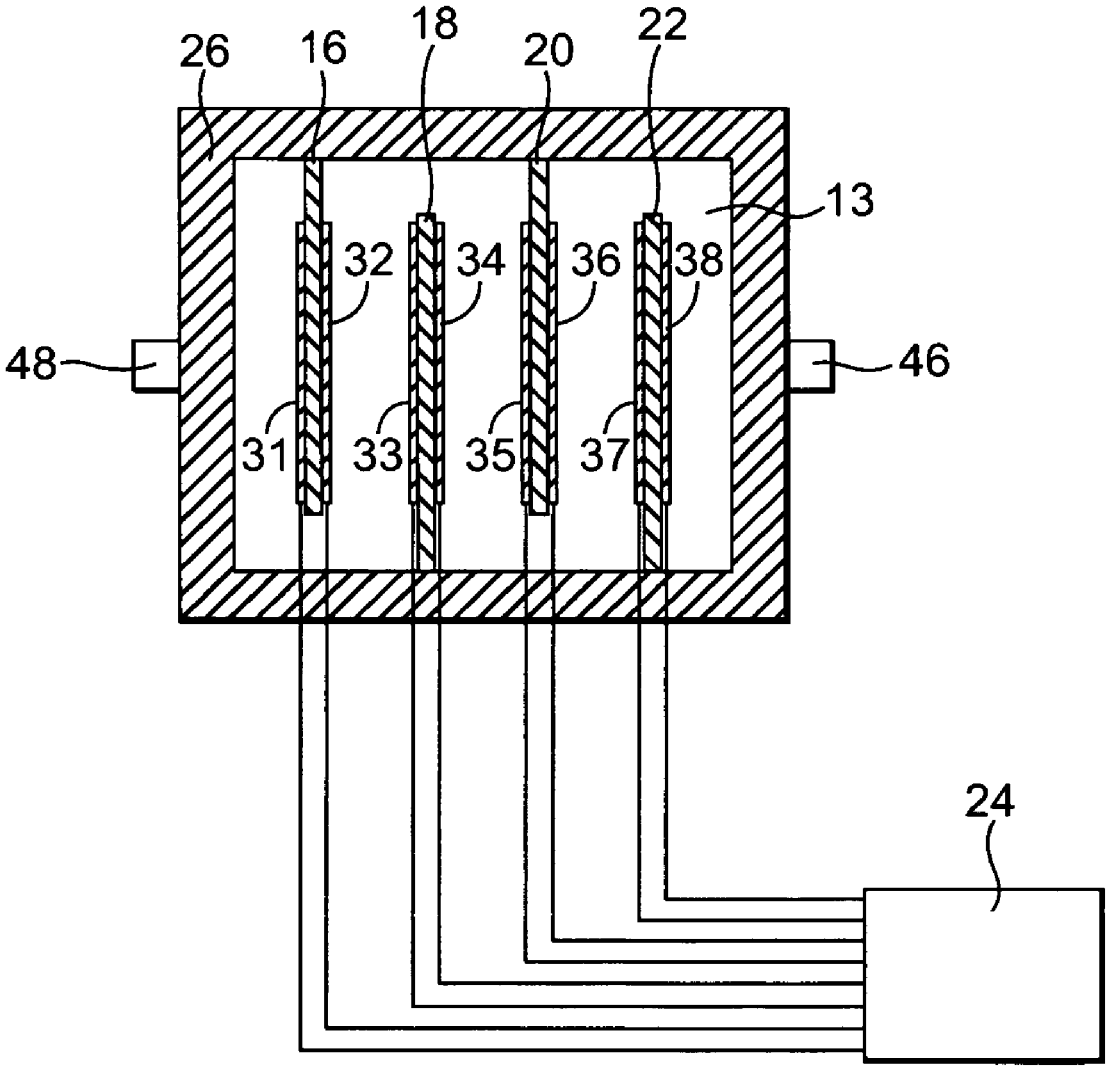
FIG. 5 is a section view of the space between the process fluid tank and the cryogenic fluid tank of the apparatus of FIG. 1 taken along the line 5-5.

In FIG. 5, a cross-sectional view of the insulating space 13 of the apparatus 10 of FIG. 1 as taken along the line 5-5 is shown. As illustrated, the heating devices 31 and 32 are preferably in contact with the heat transfer plate 16, heating devices 33 and 34 are preferably in contact with the heat transfer plate 18, heating devices 35 and 36 are preferably in contact with the heat transfer plate 20, and the heating devices, 37 and 38 are preferably in contact with the heat transfer plate 22. Also, each of the heating devices 31, 32, 33, 34, 35, 36, 37, and 38 are preferably independently controllable by the control system 24. However, any of the heating devices 31, 32, 33, 34, 35, 36, 37, and 38 may be controlled together. In any case, the control system 24 can use a control algorithm such as a PID control algorithm (Proportional/Integral/Derivative) as conventionally known. As described in further detail below, the heating devices 31, 32, 33, 34, 35, 36, 37, and 38 can be used to control or regulate the transfer of heat from the process fluid 28 to the cryogenic fluid 30 to control the temperature of the process fluid 28. Any devices capable of controllably heating any or all of the heat transfer plates 16, 18, 20, and 22 may be used. Such heating devices may include, for example, contact heaters such as resistive electrical strip heaters or heat tapes and the like, radiant heaters such as heat lamps and the like, or convective heaters such as forced air heaters and the like.

Referring to FIG. 2, the apparatus 10 preferably includes an additional heating device 76 that can be used to heat the cryogenic fluid tank 14. The heating device 76 preferably comprises one or more electrical strip heaters attached to the cryogenic fluid tank 14 and may comprise any heating device capable of adding heat to the cryogenic fluid 30 in the cryogenic fluid tank 14. The heating device 76 can be used independently or together with any of the heating devices 31, 32, 33, 34, 35, 36, 37, and 38 for the purpose of ultimately controlling the temperature of the process fluid 28. For example, the heating device 76 can be used to add heat to the cryogenic fluid 30 in the cryogenic fluid tank 14 in order to controllably permit liquid to gas evaporation of any desired portion of the cryogenic fluid 30. By boiling off a portion of the cryogenic fluid 30 in the cryogenic fluid tank 14, the heat transfer rate between the process fluid 28 in the process fluid tank 12 and the cryogenic fluid 30 in the cryogenic fluid tank 14 can be reduced.

The apparatus 10 can be made by using materials and techniques suitable for handling and containing fluids and particularly extremely cold fluids such as cryogenic fluids. With respect to the exemplary apparatus 10 described above, the process fluid tank 12 and the cryogenic fluid tank 14 are preferably formed from stainless steel. Other materials may be used depending on such factors as the overall temperature extremes expected to be experienced, any needed corrosion resistance, and thermal expansion compatibility with other materials in the apparatus 10.

Preferably, the heat transfer plates 16, 18, 20, and 22 are made from one or more materials with good thermal conductivity such as copper, for example. The heat transfer plates 16, 18, 20, and 22 can be made from any desired material or combination of materials depending on the desired thermal conductivity for the heat transfer plates 16, 18, 20, and 22. The heat transfer plates 16, 18, 20, and 22 may each be made from the same material or may be different materials.

Openings corresponding to the heat transfer plates 16, 18, 20, and 22 are preferably formed in the bottom wall portion 68 of the process fluid tank 12 and the top wall portion 72 of the cryogenic fluid tank 14 so that the heat transfer plates can be positioned within the process fluid tank 12 and the cryogenic fluid tank 14 as shown in FIGS. 2, 3, and 4. The heat transfer plates 16, 18, 20, and 22 are preferably fluidly sealed to the bottom wall portion 68 of the process fluid tank 12 and the top wall portion 72 of the cryogenic fluid tank 14. Such sealing can be done by welding, soldering, or brazing, or the heat transfer plates 16, 18, 20, and 22 may be designed to include flanges or the like that can be used to provide a seal by using gaskets, for example. One preferred technique that can be used to seal copper to stainless steel is to use silver solder as conventionally known. Any sealing technique that can provide a fluid seal between the heat transfer plates 16, 18, 20, and 22 and the process fluid tank 12 and the cryogenic fluid tank 14 may be used.

In use, a pool of the cryogenic fluid 30 is preferably provided in the cryogenic fluid tank 14 so that at least a portion of each of the heat transfer plates 16, 18, 20, and 22 is immersed in the cryogenic fluid 30. The level of the cryogenic fluid 14 can be adjusted by adding cryogenic fluid through the inlet 46 or by removing cryogenic fluid such as by using the heating device 76 to cause a controlled evaporation of the cryogenic fluid 30 through the outlet 48. This can be done with conventionally known equipment and techniques for handling cryogenic fluids. These functions are preferably integrated into and controlled by the control system 24. At the same time, process fluid 28 is preferably caused to flow through the process fluid tank 12 at a predetermined rate such as by using a pump or the like. The process fluid 28 preferably enters the process fluid tank 12 at a first temperature higher than the temperature of the cryogenic fluid 30. The process fluid 28 contacts the heat transfer plates 16, 18, 20, and 22 as the process fluid 28 flows through the process fluid tank 12 and because the temperature of the cryogenic fluid 30 is lower than the temperature of the incoming process fluid 28, heat will flow from the process fluid 28 to the cryogenic fluid 30. In this way, the temperature of the process fluid can be reduced so that the process fluid 28 exits the process fluid tank 12 at a temperature that is lower than the temperature at which the process fluid 28 enters the process fluid tank 12.

The rate of heat flow from the process fluid 28 to the cryogenic fluid 30 through the heat transfer plates 16, 18, 20, and 22 can be regulated by using the heating devices 31, 32, 33, 34, 35, 36, 37, and 38 as preferably controlled by the control system 24. Temperature sensors, as conventionally known, are preferably used to report temperature information related to the heating devices 31, 32, 33, 34, 35, 36, 37, and 38 to the control system 24. The temperature of any portions of any of the heat transfer plates 16, 18, 20, and 22, the process fluid 28, cryogenic fluid 30, and insulating space 13 can be measured and reported to the control system 24. The heating devices 31, 32, 33, 34, 35, 36, 37, and 38 can be used to heat the portion of any of the heat transfer plates 16, 18, 20, and 22 that is positioned in the insulating space 13 as mentioned above. By heating one or more of the heat transfer plate 16, 18, 20, and 22 in this way, heat transfer from the process fluid 28 to the cryogenic fluid 30 can be controlled and regulated. For example, heating one or more of the heat transfer plates 16, 18, 20, and 22 effectively slows the heat transfer rate through the heated plate. This allows the temperature of the outgoing process fluid to be accurately controlled. One preferred way to provide such control is to use conventionally known PID (Proportional/Integral/Derivative) control techniques. Such PID control techniques generally provide an algorithm that can be used to control the heating devices 31, 32, 33, 34, 35, 36, 37, and 38 in response to parameters such as a measured temperature of the process fluid 28 and a desired or setpoint temperature for the process fluid 28. In this way, the temperature of the outgoing process fluid 28 can be controlled to have a steady predetermined value within a known tolerance range or may be controllably ramped up and down depending on the desired application.

In accordance with the present invention, plural heat exchangers, such as the exemplary heat exchanger 10 described above may be used cooperatively. Such plural heat exchangers may be arranged in series or in parallel.

Under certain operating conditions, process fluid may freeze onto and accumulate on surfaces of the portions of the heat transfer plates 16, 18, 20, and 22 that are located in the process fluid tank 12. Process fluid may also freeze onto and accumulate on inside surfaces of the process fluid tank 12. This can happen, for example, where the operating temperature of the process fluid is close to its freezing temperature. When process fluid freezes onto such surfaces, a reduction in the flow rate of the process fluid can occur. The present invention advantageously provides the capability to remove such frozen process fluid from surfaces of the heat exchanger without taking the heat exchanger out of service. Any of the heating devices 31, 32, 33, 34, 35, 36, 37, and 38 can be used as desired to heat one or more of the heat transfer plates 16, 18, 20, and 22 for the purpose of removing frozen process fluid from a heat transfer plate or from any other surface of the process fluid tank 12. The control system 24 can be use to control such heating of the heat transfer plates in response to a measured flow rate, for example, or on a regular schedule such as may be empirically determined for particular operating parameters.

Additionally, the heating devices 31, 32, 33, 34, 35, 36, 37, and 38 can be used to provide a defrost function to the heat transfer plates 16, 18, 20, and 22. In use, moisture in the air in the insulating space 13 might condense and freeze onto the heat transfer plates 16, 18, 20, and 22 as a buildup of ice. Such ice buildup can reduce the efficiency of heat transfer from the process fluid 28 to the cryogenic fluid 30. If this happens, heating devices 31, 32, 33, 34, 35, 36, 37, and 38 can be used to remove such ice build up by heating one or more of the heat transfer plates 16, 18, 20, and 22. For example, one or both of the heating devices 31 and 32 can be used to heat the heat transfer plate 16, one or both of the heating devices 33 and 34 can be used to heat the heat transfer plate 18, one or both of the heating devices 35 and 36 can be used to heat the heat transfer plate 20, and one or both of the heating devices, 37 and 38 can be used to heat the heat transfer plate 22. Preferably, the heating devices 31, 32, 33, 34, 35, 36, 37, and 38 are controlled by the control system 24. The heating devices 31, 32, 33, 34, 35, 36, 37, and 38 can be used to defrost the heat transfer plates 16, 18, 20, and 22 sequentially, independently from each other, or in groups or batches depending on the particular defrost needs. Advantageously, when done independently the system 10 can remain in service.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

What is claimed is:

1. An apparatus for controlling the temperature of a process fluid, the apparatus comprising:

a cryogenic fluid tank containing a cryogenic fluid within an interior portion of the cryogenic fluid tank;

a process fluid tank comprising an inlet and an outlet through which a process fluid circulates through an interior portion of a the process fluid tank, the process fluid tank spaced from the cryogenic fluid tank to define an insulating space between the cryogenic fluid tank and the process fluid tank;

a plurality of heat transfer devices transferring heat between the process fluid in the process fluid tank and the cryogenic fluid in the cryogenic fluid tank, each of the heat transfer devices extending at least partially through both of the interior portions and between opposing sidewalls of the process fluid tank and the cryogenic fluid tank, each of the heat transfer devices comprising a first portion positioned in the cryogenic fluid tank wherein the first portion contacts the cryogenic fluid in the cryogenic fluid tank, a second portion positioned in the process fluid tank wherein the second portion contacts the process fluid in the process fluid tank, and a third portion positioned in the insulating space between the cryogenic fluid tank and the process fluid tank; and a heater being controlled to add heat to the third portion of the heat transfer devices to control the rate of heat transfer between the process fluid in the process fluid tank and the cryogenic fluid in the cryogenic fluid tank.

2. The apparatus of claim 1, wherein each of the heat transfer devices comprises a thermally conductive body.

3. The apparatus of claim 2, wherein the thermally conductive body comprises a metal plate.

4. The apparatus of claim 3, wherein the metal plate comprises copper.

5. The apparatus of claim 1, wherein the heat transfer devices are arranged in the process fluid tank to provide a predetermined fluid path between the inlet and outlet of the process fluid tank.

6. The apparatus of claim 5, wherein the heat transfer devices are substantially evenly spaced across a distance between opposing sidewalls of the process fluid tank.

7. The apparatus of claim 6, wherein each of the heat transfer devices define a gap between sidewall portions of the process fluid tank and an end portion of the heat transfer devices.

8. The apparatus of claim 1, wherein the insulating space between the cryogenic fluid tank and the process fluid tank comprises an air gap between a surface of the cryogenic tank and a surface of the process tank.

9. The apparatus of claim 1, further comprising a control system configured to control the heater for the third portion of the heat transfer devices in response to a measured temperature of at least one of the cryogenic fluid in the cryogenic fluid tank and the process fluid in the process fluid tank to control the temperature of the process fluid.

10. The apparatus of claim 1, further comprising a heater being controlled to heat at least a portion of the cryogenic fluid tank to supply heat to the cryogenic fluid in the cryogenic fluid tank.

11. The apparatus of claim 10, further comprising control means for controlling the heater for the cryogenic fluid tank in response to a measured temperature of at least one of the cryogenic fluid in the cryogenic fluid tank and the process fluid in the process fluid tank to control the temperature of the process fluid.

12. The apparatus of claim 1, further comprising an insulating shell enclosing at least a portion of the cryogenic fluid tank, the process fluid tank, and the insulating space between the cryogenic fluid tank and the process fluid tank.

13. A method for controlling the temperature of a process fluid, the method comprising the steps of:

providing a cryogenic fluid tank and a process fluid tank, the cryogenic fluid tank and the process fluid tank spaced from each other to define an insulating space between the cryogenic fluid tank and the process fluid tank;

providing a quantity of cryogenic fluid in an interior portion of the cryogenic fluid tank to thermally affect a first portion of a plurality of heat transfer devices within the cryogenic fluid tank;

circulating a process fluid within an interior portion of the process fluid tank to flow over a second portion of the heat transfer devices within the process fluid tank; and transferring heat through the heat transfer devices from the process fluid to a third portion of the heat transfer devices within the insulating space between the cryogenic fluid tank and the process fluid tank, wherein each of the heat transfer devices extend at least partially through both of the interior portions and between opposing sidewalls of the process fluid tank and the cryogenic fluid tank.

14. The method of claim 13, farther comprising the step of transferring heat through the heat transfer devices from the third portion of the heat transfer devices to the cryogenic fluid.

15. The method of claim 13, farther comprising the step of flowing the process fluid through the process fluid tank.

16. The method of claim 13, wherein each of the heat transfer devices comprises at least one thermally conductive body that provides the first, second, and third portions of the heat transfer devices.

17. The method of claim 16, wherein the at least one thermally conductive body comprises a metal plate.

18. The method of claim 17, wherein the metal plate comprises copper.

19. The method of claim 13, further comprising the step of controlling the temperature of the third portion of the heat transfer devices to control the temperature of the process fluid in the process fluid tank.

20. The method of claim 19, wherein the temperature of the third portion of the heat transfer devices is controlled in response to a measured temperature of the process fluid in the process fluid tank.

21. The method of claim 13, further comprising the step of controlling the temperature of the cryogenic fluid in the cryogenic fluid tank to control the temperature of the process fluid in the process fluid tank.

22. The method of claim 21, wherein the temperature of the cryogenic fluid in the cryogenic fluid tank is controlled in response to a measured temperature of the process fluid in the process fluid tank.

23. A method for controlling the temperature of a process fluid, the method comprising the steps of:

providing a cryogenic fluid tank and a process fluid tank, the cryogenic fluid tank and the process fluid tank spaced from each other to define an insulating space between the cryogenic fluid tank and the process fluid tank;

immersing a first portion of a plurality of heat transfer devices into a cryogenic fluid provided in an interior portion of the cryogenic fluid tank;

immersing a second portion of the heat transfer devices into a process fluid provided in an interior portion of the process fluid tank;

providing a third portion of the heat transfer devices in the insulating space between the cryogenic fluid tank and the process fluid tank;

transferring heat, through the heat transfer devices, from the process fluid to the cryogenic fluid; and regulating the transfer of heat through the heat transfer devices from the process fluid to the cryogenic fluid to control the temperature of the process fluid in the process fluid tank;

wherein each of the heat transfer devices extend at least partially through both of the interior portions and between opposing sidewalls of the process fluid tank and the cryogenic fluid tank.

24. The method of claim 23, further comprising the step of flowing the cryogenic fluid through the cryogenic fluid tank.

25. The method of claim 23, further comprising the step of flowing the process fluid through the process fluid tank.

26. The method of claim 23, wherein each of the heat transfer devices comprises at least one thermally conductive body that provides the first, second, and third portions of the heat transfer devices.

27. The method of claim 26, wherein the at least one thermally conductive body comprises a metal plate.

28. The method of claim 27, wherein the metal plate comprises copper.

29. The method of claim 23, wherein the step of regulating the transfer of heat through the heat transfer devices comprises controlling the temperature of the third portion of the heat transfer devices.

30. The method of claim 29, wherein controlling the temperature of the third portion of the heat transfer devices comprises indirectly heating the third portion of the heat transfer devices by controlling the temperature of ambient air in the insulating space between the cryogenic fluid tank and the process fluid tank.

31. The method of claim 29, wherein controlling the temperature of the third portion of the heat transfer devices comprises directly heating the third portion of the heat transfer devices by controllably heating the third portion of the heat transfer devices with a heater in contact with the third portion of the heat transfer devices.

32. The method of claim 29, wherein the temperature of the third portion of the heat transfer devices is controlled in response to a measured temperature of the process fluid in the process fluid tank.

33. The method of claim 23, further comprising the step of controlling the temperature of the cryogenic fluid in the cryogenic fluid tank to control the temperature of the process fluid in the process fluid tank.

34. The method of claim 33, wherein the temperature of the cryogenic fluid in the cryogenic fluid tank is controlled in response to a measured temperature of the process fluid in the process fluid tank.

* * * * *